US007895667B2

(12) United States Patent
Zmigrosky

(10) Patent No.: US 7,895,667 B2
(45) Date of Patent: Mar. 1, 2011

(54) HUNTING AND SPORTING SUIT FOR FEMALES

(75) Inventor: Shelah K. Zmigrosky, Frisco, TX (US)

(73) Assignee: Shelah K Zmigrosky, Frisco, TX (US)

( * ) Notice: Subject to any disclaimer, the term of this patent is extended or adjusted under 35 U.S.C. 154(b) by 80 days.

(21) Appl. No.: 12/472,121

(22) Filed: May 26, 2009

(65) Prior Publication Data

US 2009/0229034 A1 Sep. 17, 2009

Related U.S. Application Data

(63) Continuation-in-part of application No. 11/743,950, filed on May 3, 2007, now abandoned.

(51) Int. Cl.
*A41D 13/00* (2006.01)

(52) U.S. Cl. ..... 2/4; 2/69

(58) Field of Classification Search ..... 2/4, 9, 108, 2/85, 93, 94, 95, 69, 69.5, 79, 227, 228, 115, 2/113, 114, 102
See application file for complete search history.

(56) References Cited

U.S. PATENT DOCUMENTS

| | | | | | |
|---|---|---|---|---|---|
| 236,825 | A | | 1/1881 | Maltby | |
| 1,183,511 | A | | 5/1916 | Adams | |
| 4,395,781 | A | | 8/1983 | Myers | |
| 4,422,184 | A | | 12/1983 | Myers | |
| 4,685,152 | A | | 8/1987 | Heare | |
| 5,010,595 | A | * | 4/1991 | Stradley | 2/227 |
| 5,357,635 | A | * | 10/1994 | Lemoine | 2/84 |
| 5,718,000 | A | * | 2/1998 | Ost et al. | 2/69 |
| 5,794,263 | A | * | 8/1998 | Carman | 2/84 |
| 6,161,223 | A | | 12/2000 | Andrews | |

* cited by examiner

*Primary Examiner* — Gloria Hale

(57) ABSTRACT

A hunting and sporting garment that conceals a user's face includes a hood, a face covering, an attachment between the face covering and the hood, and at least one pocket and/or collar to store the face covering and hood. The garment further includes a lower portion having a crotch opening between the leg portions conforming to the contour of the crotch seam, wherein the crotch opening is capable of being closed.

6 Claims, 6 Drawing Sheets

HUNTING AND SPORTING SUIT FOR FEMALES

CROSS-REFERENCE TO RELATED APPLICATION

This application is a continuation-in-part application of U.S. patent application Ser. No. 11/743,950 filed May 3, 2007, now abandoned, the entire contents of which are incorporated herein by reference.

BACKGROUND AND SUMMARY

The present invention comprises a hunting and sporting garment for females which is equipped with means for concealing the female wearer's face comprising a hood, a face covering, means for attaching the face covering to the hood to form the concealing means, and means for storage of the face covering and hood when not in use. The garment further includes a crotch opening and closure means thereby enabling a female wearer of the garment to conveniently and safely perform bodily waste functions without removing the garment or a portion thereof.

One-piece and two-piece suits, such as cover-alls, snowsuits, etc. are commonly utilized by hunters, sportsmen and women, and other outdoorsmen and women to provide warmth and protection from the elements. Hunters commonly wear suits with a camouflage pattern to conceal themselves from the bird or animal which they are hunting. Suits intended to be used in cold weather are insulated and bulky, while suits intended to be used in warmer weather are lighter weight and breathable, etc. Participants in outdoor sports such snow skiing and snow boarding, snowmobiling, motorcycling, fishing, etc. also utilize one-piece and two-piece suits.

Prior art hunting and sporting garments commonly incorporate means for covering and/or concealing the face of the wearer. This is desirable when performing hunting activities so as to further hide oneself from a bird or animal which is being hunted. The face covering means also provide additional protection from the elements, such as protection from wind and/or blowing rain or snow.

Common face concealing means often comprise a separate garment, such as a facemask. The use of a separate garment is undesirable, as the facemask can be easily misplaced if removed while a hunting or sporting activity is being performed. Other common face concealing means comprise a facemask that permanently is attached to the hood or neck portion of the hunting or sporting garment. The prior art face concealing means are undesirable because they are easily displaced from their ideal orientation with respect to a user's face, thereby causing a user's vision to be obscured and/or cannot be removed and easily stored when not in use.

Accordingly, there is a need for a face concealing device that does not obscure the vision of the wearer when in use and means for storing the face concealing device when not in use.

Additionally, outdoor sports normally take place in locations where access to formal restroom facilities is limited or non-existent, such as forests and other wooded areas, mountains, lakes, streams, rivers, open fields, etc. Further, such sports are commonly engaged in over relatively long time periods. Therefore, the need to relive oneself of bodily waste arises.

Difficulties in voiding bodily wastes are inherent in prior art hunting and sporting suits. Generally, such garments have a lower portion, such as pants or the like, generally having an opening at a seam, the seam transecting the lower portion of the garment through the crotch from the waistband in the back of the lower portion of the garment to the waistband in the front of the lower portion of the garment. The opening is generally closeable by a zipper, a set of buttons, hook-and-loop fasteners such as VELCRO®, or other suitable closure. The opening is typically located in the front of the transecting seam between the waistband and a point forward of the center point of the transecting seam.

The location of the opening in prior art hunting and sporting garments allows men to perform bodily waste functions, such as urination, without removing the garment or a portion thereof. However, the location of the opening is inconvenient, uncomfortable, and potentially hazardous when the performance of other bodily waste functions, such as defecation, are attempted by men without removing the garment, and wholly inconvenient, uncomfortable, and potentially hazardous when the performance of any bodily waste function is attempted by women without removing the garment.

In order for females to perform bodily waste functions while wearing prior art garments, or for men to perform certain bodily waste functions, it is necessary for the wearer to remove the garment or a portion thereof, substantially undressing the more private parts of the body. This is undesirable, especially in cold weather. It is further necessary for the wearer of the garment to assume an uncomfortable position in order to perform the necessary bodily function(s). The positions customarily chosen for performing such bodily functions may occasionally lead to accidents such as unwanted soiling of the garment, loss of balance, embarrassing falls, and injury.

Accordingly, there is a need for an opening and closure system for a hunting and sporting garment particularly adapted for female usage that allows a wearer of the garment to conveniently and safely perform bodily waste functions without significantly undressing and without being compelled to assume an inherently uncomfortable and dangerous position.

In accordance with the present invention a hunting and sporting suit for females comprises a face concealing means incorporated into an upper component of the garment. The face concealing means includes a facemask for covering the face of the wearer of the garment. The facemask attaches to a hood secured to the upper component of the garment by closure means that permits the facemask to be removed from the hood and stored in a pocket of the upper component. The closure means may be a zipper, a set of buttons, a hook-and-loop fasteners such as VELCRO®), etc. Further, the hood may be stored within the collar portion of the upper component of the garment.

The hunting and sporting suit for females comprising the present invention further comprises a lower portion. A crotch seam transects the lower portion from the waist band in the back of the lower portion to the waist band in the front of the lower portion. An opening conforms to the contour of the crotch seam from a point behind the center point of the transecting seam to a point located proximately to the waistband in the front of the lower portion. The opening in the seam may be closed by various closure means such as a zipper, a set of buttons, hook-and-loop fasteners such as VELCRO®, etc.

The upper component of the garment may be separate from the lower portion of the garment or the upper and lower portions may be combined so as to form a unitary hunting and sporting garment for females.

BRIEF DESCRIPTION OF THE DRAWINGS

A more complete understanding of the present invention may be had by reference to the following Detailed Description when taken in connection with the accompanying Drawings, wherein.

DETAILED DESCRIPTION

Figure 1:
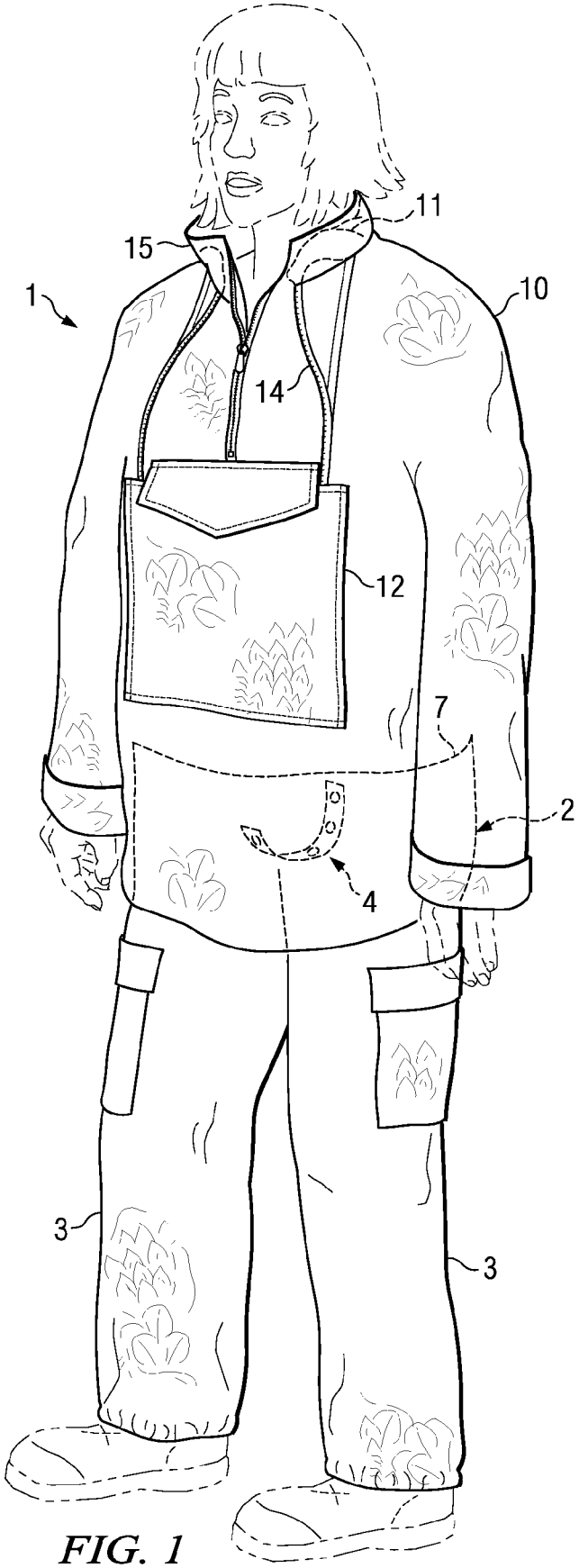
FIG. 1 is a perspective view of a hunting and sporting suit for females comprising a first embodiment of the present invention.
Figure 2:
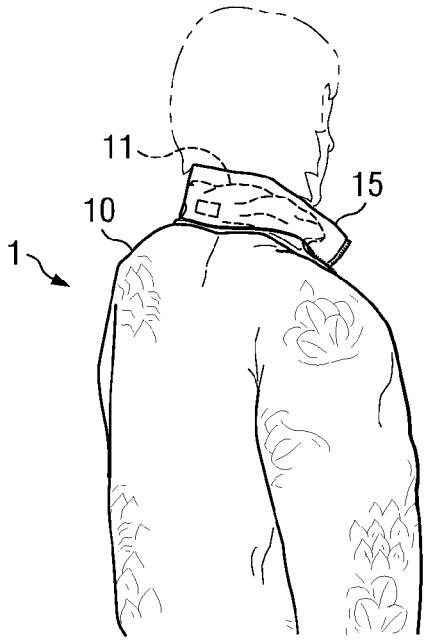
FIG. 2 is a perspective view of the back of an upper component of the hunting and sporting suit comprising the present invention showing storage of a hood.
Figure 3:
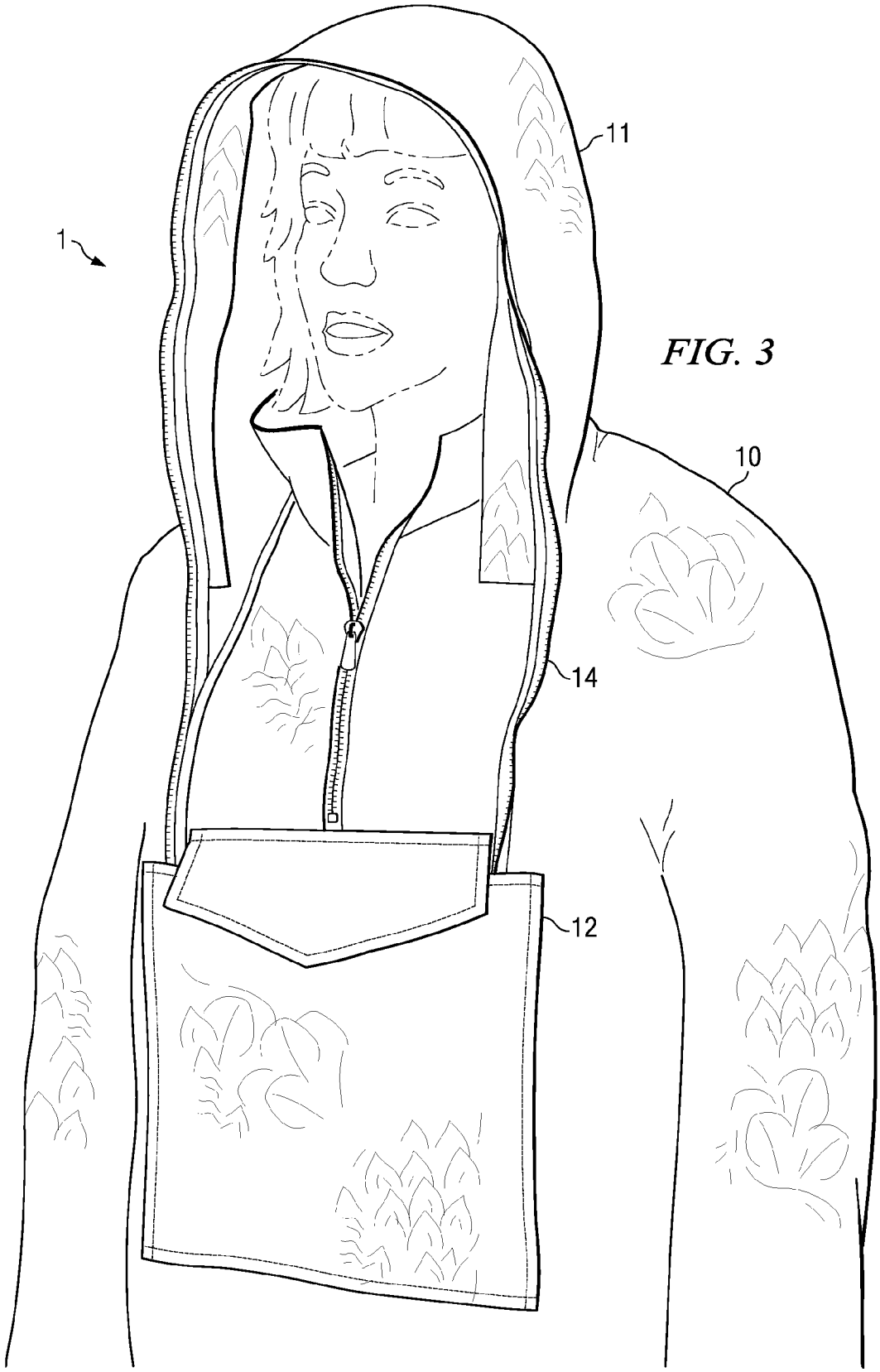
FIG. 3 is a perspective view of an upper component of the hunting and sporting suit comprising the present invention showing storage of a face concealing means.
Figure 4:
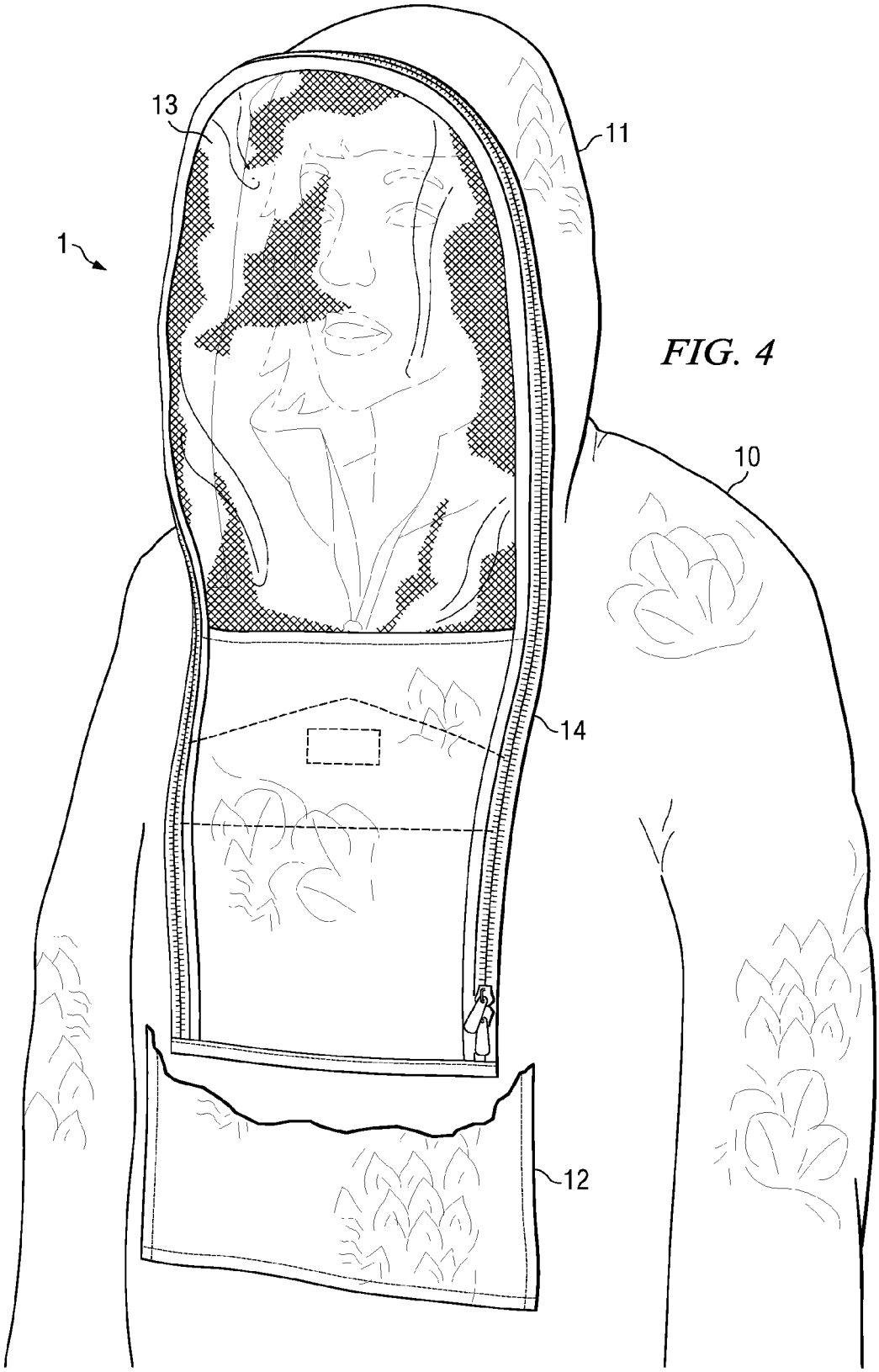
FIG. 4 is a perspective view of an upper component of the hunting and sporting suit comprising the present invention showing use of a face concealing means.

Referring now to the drawings, and particularly to FIGS. 3-6, a hood 11 of an upper component 10 of a hunting and sporting suit for females 1 comprises the present invention is shown attached to the upper component 10. The hood 11 can be permanently attached to the upper component 10 or it can be removably attached to the upper component 10. Further, the hood can affixed to the upper component 10 so as to allow storage within a collar portion 15 of the upper component 10 as is shown in FIGS. 1 and 2. Referring to FIG. 1 and FIGS. 3-4, a pocket 12 is shown on the front of the upper component 10. The pocket 12 can be sewn onto the outside of the upper component 10 or alternatively can be integrally disposed within the upper component 10 so as to form a seamless pocket. The pocket 12 is configured so as to receive a facemask 13 portion of a face concealing means so as to store the facemask.

Figure 5:
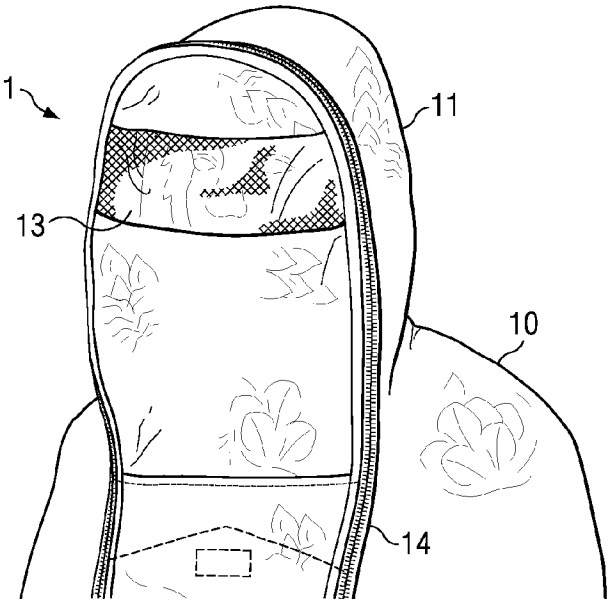
FIG. 5 is a perspective view of part of an upper component of the hunting and sporting suit comprising the present invention showing use of an alternate face concealing means.

Referring now to FIGS. 4-5, a face concealing means comprising a facemask 13 is shown covering the face of the female wearer; FIG. 4 illustrating a mesh face concealing device extending across the entire face of the female wearers and FIG. 5 illustrating a face concealing device wherein the mesh component is designed with the eyes of the female wearer. The facemask 13 can be permanently attached to the upper component 10 by means of sewing as shown in FIG. 4 or it can be removably attached to the upper component 10 by means of hook-and-loop fasteners, snaps, etc. The facemask 13 attaches to the hood 11 of the upper component 10 of the garment 1 via a closure means 14 so as to form the face concealing means. The closure means 14 may be a zipper, a set of buttons, a hook-and-loop fastener such as VELCRO®, a set of male/female snaps, lace and eyelet means, etc. Importantly, the facemask 13 attaches to the upper component 10 so as to allow it to be placed in the pocket 12 for storage when not in use, as shown in FIG. 3.

Figure 6:
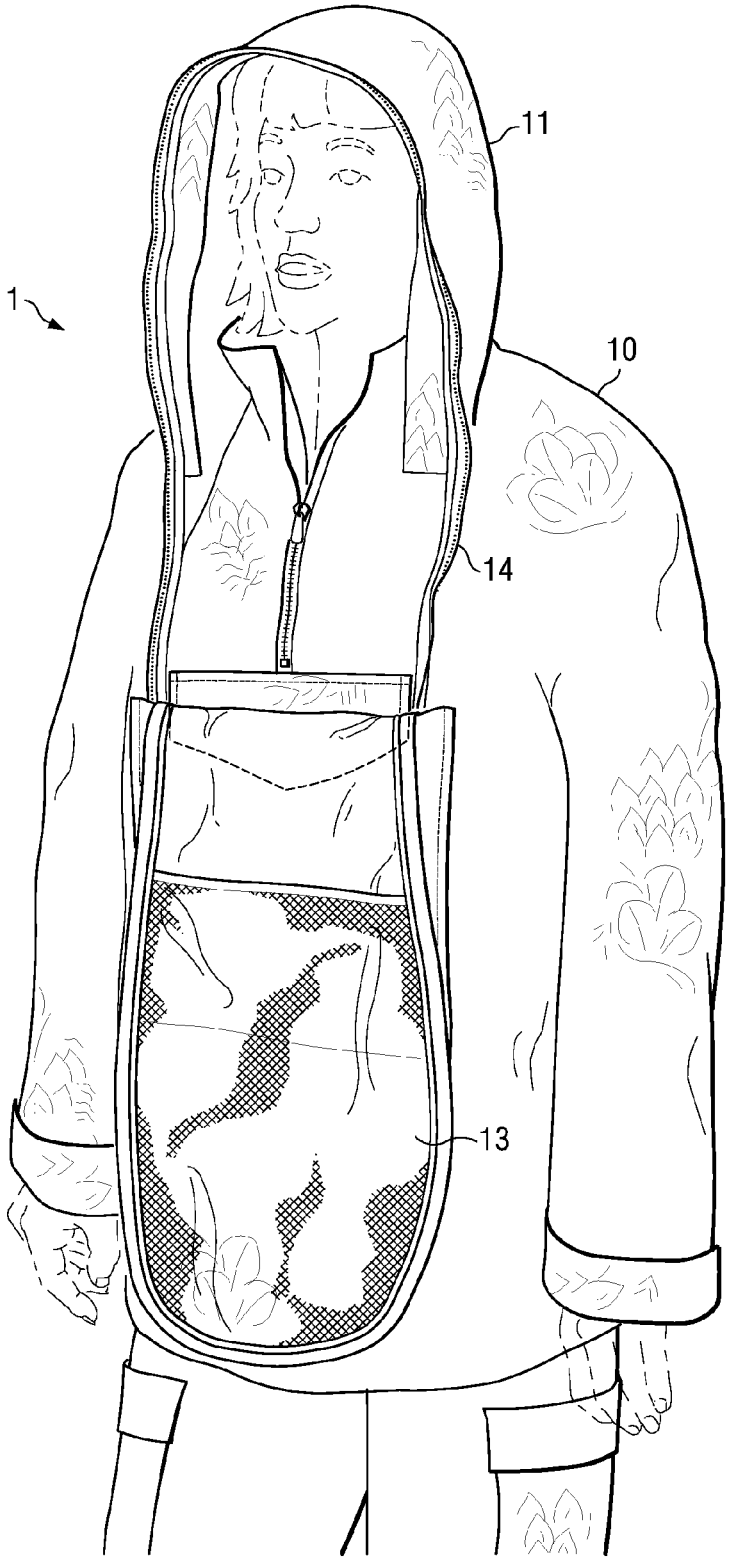
FIG. 6 is a perspective view of the hunting and sporting suit comprising the present invention wherein a face concealing means is positioned so as to hang in front of the upper component of the garment.

Alternatively, the facemask 13 can be allowed to hang freely in the front of the upper component 10 of the garment 1. Referring to FIG. 6, the facemask 13 is displaced from the face of the wearer and is shown hanging from its point of attachment to the upper component 10.

Referring again to FIG. 1, the hunting and sporting suit for females 1 of the present invention having a lower portion 2 further comprising two leg portions 3 and a crotch opening 4 located between the leg portions 3 at a seam attaching the leg portions 3 to one another. The crotch opening 4 comprises a closure means 6 for closing the crotch opening 4. The closure means 6 may be a zipper, a set of buttons, a hook-and-loop fastener such as VELCRO®, a set of male/female snaps, lace and eyelet means, etc. A waistband 7 defines the upper limit of the lower portion 2. The lower portion 2 can be attached to the upper component 10 at the waistband 7, or the lower portion 2 and upper component 10 can be separate.

Figure 7:
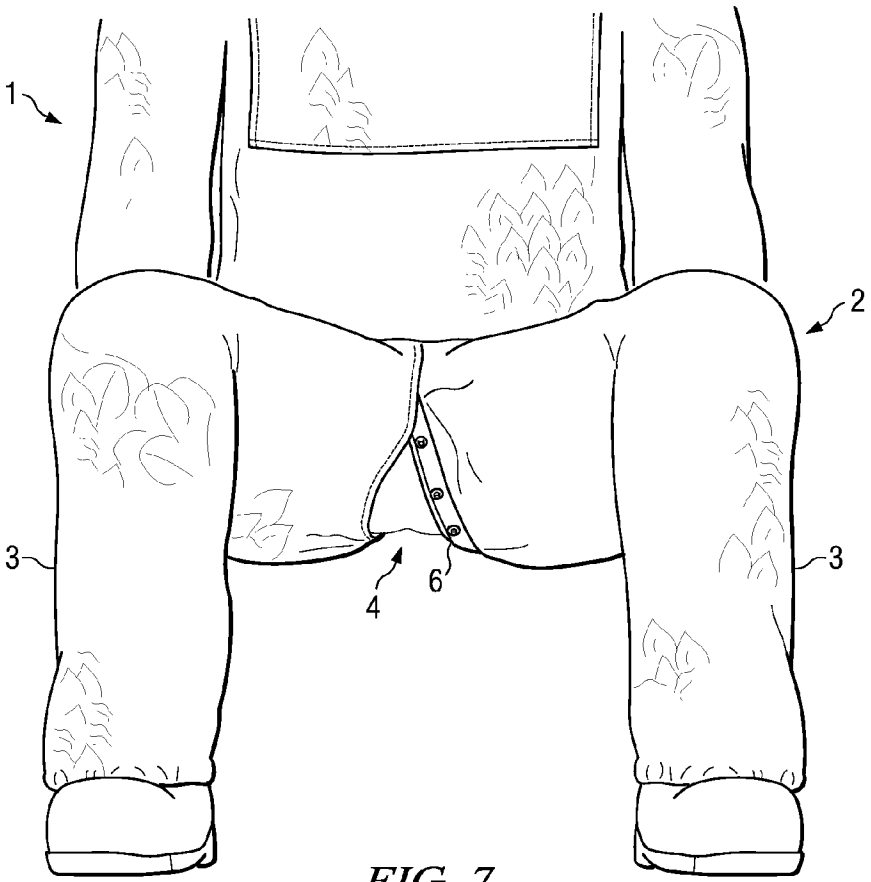
FIG. 7 is a frontal view of the lower portion of the hunting and sporting suit of the present invention wherein an opening in a crotch seam of the garment is shown.

Referring to FIG. 7, utilization of the crotch opening 4 for the purpose of performing a bodily waste function is shown. The closure means 6 of the crotch opening 4 is shown in its open position. By utilizing the closure means 6, a user of the garment 1 can conveniently and safely perform necessary bodily waste functions without removing the garment 1 or the lower portion 2 thereof.

Figure 8:
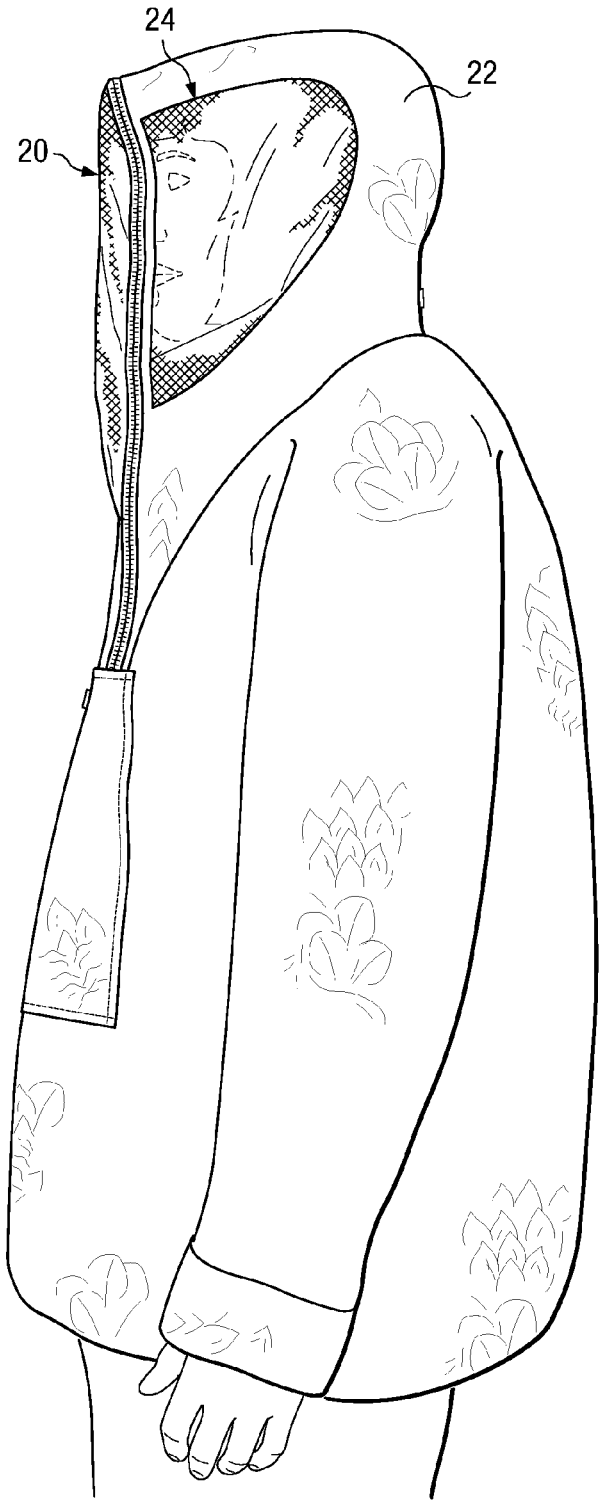
FIG. 8 is a side view of the hunting and sporting suit comprising a second embodiment of the invention.

FIG. 8 illustrates a hunting and sporting suit for females 20 comprising a second embodiment of the invention. The hunting and sporting suit for females 20 is substantially identical in construction and function to the hunting and sporting suit for females 1 as illustrated in FIGS. 1-7, inclusive and described hereinabove in conjunction therewith. The hunting and sporting suit for females 20 differs from the hunting and sporting suit for females 1 in that it is equipped with a hood 22 having mesh panels 24 formed on both sides thereof, that is, the right side and the left side of the head of a user of the hunting and sporting suit 20 and aligned with the eyes of the female wearer. The mesh panels 24 are highly advantageous in facilitating hunting and sporting activities. The mesh panels 24 also afford safety for the user of the hunting and sporting suit 20 by making the user aware of both airborne and stationary objects that might otherwise engage the head of the user.

Referring now to FIGS. 1-7, FIGS. 1 and 2 show typical utilization of the hunting and sporting suit for females of the present invention before a hunting or sporting activity is performed, for instance in a lodge, traveling in a vehicle, or when getting ready to perform a hunting or sporting activity. FIG. 3 shows typical utilization of the hunting and sporting suit for females of the present invention in situations where it is not necessary to fully cover or protect one's face, but where the user desires the additional protection of a hood, for instance on cooler days, rainy days, etc. FIGS. 4, 5 and 8 show typical utilization of the hunting and sporting suit for females of the present invention during a hunting or sporting activity, specifically during situations where it is necessary to fully cover one's face to provide concealment from an animal or bird that is being hunted or to provide protection from the elements. FIG. 6 shows typical utilization of the hunting and sporting suit for females of the present invention after a hunting or sporting activity has been performed, for instance after an animal or bird has been harvested, during the retrieval and dressing of a harvested animal or bird, or after another sporting activity has been performed, but where it is not necessary or desirable to take the additional time to store the facemask in the pocket of the upper component of the suit. Finally, FIG. 7 shows typical utilization of the hunting and sporting suit for females of the present invention during the performance of a bodily function, for instance if one is performing a hunting or sporting activity in a remote area without restroom facilities over a long time period.

Although preferred embodiments of the invention have been illustrated in the accompanying Drawings and described in the foregoing Summary and Detailed Description, it will be understood that the invention is not limited to the embodiments disclosed, but is capable of numerous rearrangements, modifications, and substitutions of parts and elements without departing from the spirit of the invention.

The invention claimed is:

1. A hunting and sporting suit for females comprising:

an upper component comprising a front side and a back side, said front side and said back side each having an opening at a lower end for receiving the upper torso of a female wearer and having an opening at an upper end for receiving the neck of said female wearer;

a hood secured to an upper end of the upper component for selectively receiving the head of the female wearer, said hood having side walls extending adjacent the head of the female wearer, said side walls including mesh panels aligned with the eyes of said female wearer to facilitate viewing, and said hood further having an open front aligned with the face of said female wearer;

a collar extending around the opening at the upper end of the upper component, wherein the hood is stored within the collar when not in use;

a pocket secured to the front side of the upper component and defined by an upper edge, opposed side edges, and a lower edge, wherein said opposed side edges and said bottom edge are secured to the front side of the upper component and said upper edge defining an opening affording access to the interior of said pocket;

a facemask comprising a lower edge secured to the front side of the upper component within the pocket and an upper edge, said facemask further comprising a mesh panel aligned with the eyes of the female wearer to facilitate viewing;

a zipper for selectively securing the upper edge of the facemask to the the hood to thereby selectively remove and secure the facemask to the hood to hide and protect the face of the female wearer as desired; and when not in use, said facemask is stowed within the pocket.

2. The hunting and sporting suit for females according to claim 1, wherein the hood is removably attached to the upper component.

3. The hunting and sporting suit for females according to claim 1, wherein the pocket is sewn onto the outside of the front side of the upper component.

4. The hunting and sporting suit for females according to claim 1, wherein the pocket is is formed as part of the upper component.

5. The hunting and sporting suit for females according to claim 1, further comprising a zipper extending downwardly from the opening at the upper end of the upper component to facilitate donning of the upper portion by a female wearer.

6. The hunting and sporting suit for females according to claim 1, further comprising:

a lower portion including two leg portions connected by a crotch seam which transects the lower portion from a waist band at the back of the lower portion to the waist band at the front of the lower portion;

an opening conforming to the contour of the crotch seam;

and closure means for closing the opening in the crotch seam.

* * * * *